US007766252B2

(12) United States Patent
Jackson et al.

(10) Patent No.: US 7,766,252 B2
(45) Date of Patent: Aug. 3, 2010

(54) DRY SPRINKLER ASSEMBLY

(75) Inventors: Eldon D. Jackson, Hastings, MI (US); Shawn J. Feenstra, Caledonia, MI (US)

(73) Assignee: The Viking Corporation, Hastings, MI (US)

( * ) Notice: Subject to any disclaimer, the term of this patent is extended or adjusted under 35 U.S.C. 154(b) by 242 days.

(21) Appl. No.: 11/354,644

(22) Filed: Feb. 15, 2006

(65) Prior Publication Data

US 2007/0187116 A1 Aug. 16, 2007

(51) Int. Cl.
*A62C 37/08* (2006.01)

(52) U.S. Cl. ..... 239/37; 239/41; 239/38; 239/17; 137/72; 137/79

(58) Field of Classification Search ..... 169/37, 169/41, 16, 17; 137/72, 79
See application file for complete search history.

(56) References Cited

U.S. PATENT DOCUMENTS

| | | | | | |
|---|---|---|---|---|---|
| 1,903,150 | A | | 3/1933 | Tyden | |
| 2,291,818 | A | * | 8/1942 | Loepsinger | 169/37 |
| 3,007,528 | A | * | 11/1961 | Gloeckler | 169/41 |
| 3,584,689 | A | | 6/1971 | Willms | |
| 4,007,878 | A | | 2/1977 | Anderson | |
| 4,177,862 | A | * | 12/1979 | Bray | 169/17 |
| 4,220,208 | A | | 9/1980 | Jackson et al. | |
| 4,228,858 | A | * | 10/1980 | Sclafani | 169/41 |
| 4,417,626 | A | | 11/1983 | Hansen | |
| 4,511,003 | A | | 4/1985 | Randall | |
| 4,981,179 | A | * | 1/1991 | Klein | 169/38 |
| 5,188,185 | A | * | 2/1993 | Mears | 169/37 |
| 5,257,827 | A | | 11/1993 | Takeuchi et al. | |
| 5,415,239 | A | * | 5/1995 | Kotter et al. | 169/41 |
| 5,775,431 | A | * | 7/1998 | Ondracek | 169/37 |
| 5,829,532 | A | | 11/1998 | Meyer et al. | |
| 5,862,994 | A | * | 1/1999 | Pounder et al. | 239/498 |
| 6,851,482 | B2 | | 2/2005 | Dolan | |
| 6,976,543 | B1 | | 12/2005 | Fischer | |
| 7,516,800 | B1 | * | 4/2009 | Silva et al. | 169/37 |
| 2005/0173562 | A1 | | 8/2005 | Franson et al. | |
| 2006/0113093 | A1 | * | 6/2006 | Silva | 169/37 |
| 2007/0187116 | A1 | | 8/2007 | Jackson et al. | |
| 2008/0257564 | A1 | | 10/2008 | Cordell et al. | |

OTHER PUBLICATIONS

Photographs (3) of "Viking's Standard Response Coverage Dry Sprinkler" (2000).

* cited by examiner

*Primary Examiner*—Dinh Q Nguyen
(74) *Attorney, Agent, or Firm*—Harness, Dickey & Pierce, P.L.C.

(57) ABSTRACT

A dry pipe sprinkler assembly is provided including a sprinkler body having a thermally responsive trigger mounted thereto. A housing, including an inlet end and an outlet end is provided with the outlet end being connected to the sprinkler body. A seal member is disposed at the inlet end of the housing, and a load mechanism extends between the thermally responsive element and the seal member. The load mechanism may include a support portion, a passage tube portion, and an outlet orifice portion slidably received within the housing and movable within the housing upon activation of the thermally responsive trigger to allow the seal member to be dislodged from the inlet end of the housing to allow suppressant fluid to flow therethrough. The dry pipe sprinkler assembly allows the use of different outlet orifice members to provide dry pipe sprinkler assemblies having different K factors while utilizing common components for the remaining dry pipe sprinkler assembly.

1 Claim, 7 Drawing Sheets

DRY SPRINKLER ASSEMBLY

FIELD

The present disclosure relates to automatically operated fire extinguishing systems used for buildings, and relates specifically to fire extinguishing systems of the dry pipe type which normally exclude water from the sprinkler until a fire occurs in the vicinity of one or more sprinklers.

BACKGROUND AND SUMMARY

The statements in this section merely provide background information related to the present disclosure and may not constitute prior art.

Dry-type sprinklers for fire protection systems have been available for many years. The dry-type sprinklers can be installed in either an upright or a pendant position, according to design. Generally speaking, dry pipe sprinklers comprise a sprinkler adapted to be installed in a piping system, the sprinkler having a valve at the inlet end to prevent water or other fire extinguishing fluid in the pipeline from entering the sprinkler until the sprinkler is put into operation by collapse of a thermally responsive mechanism. The valve end of the sprinkler is screwed into or otherwise attached to a fitting in the water supply piping. This type of dry-pipe sprinkler is particularly useful for suppression or controlling a fire situation in a warehouse area that is generally controlled to maintain a temperature below freezing for the fire suppressant liquid. In many warehouse coolers and freezers, the compartment that is controlled at a cool or freezing temperature is a box enclosure within a heated warehouse or building compartment. The sprinkler system desired for control or suppression against fire is typically a wet pipe system that includes water or fire suppressant pressurized up to the sprinkler assembly for rapid discharge of fluid or gas at the time of operation of the heat sensitive sprinkler trigger assembly.

Current methods used to protect cool or freezing areas is to fill a system with anti-freeze and limit the volume of anti-freeze to provide adequate time to expel the anti-freeze before filling with water to suppress or control the fire, or the use of a dry pipe system or pre-action system that includes filling the piping system with air or gas to pressurize the piping system and apply water after detection of the fire expelling all the air in the piping before water is delivered to the protected area through the sprinkler assembly. For suppression mode sprinklers, it is desired to use only wet systems due to rapid discharge requirements of fire suppressant to extinguish the fire. Current dry pipe sprinkler technology uses smaller sprinkler assemblies having K factors less than 14. Current dry sprinkler assemblies on the market do not allow protection of large warehouse areas with ceiling only protection above 25 feet and greater. Protection of large warehouse areas with ceiling heights above 25 feet require larger sprinklers having a K factor of 14 and greater which are designed as early suppression fast response (ESFR) or large orifice with a K factor of 14 and for use as a control mode sprinkler, protection of stored warehouse material in coolers or freezer compartments. For ESFR sprinklers, the heat responsive trigger has a response time index (RTI) of less than 100 meter$^{1/2}$ sec$^{1/2}$. Current dry sprinkler assemblies include many components and require close tolerance of the length of the component assembly to maintain accurate and consistent quality assemblies.

Accordingly, it is desirable to provide a dry pipe sprinkler design that is adjustable for allowance of greater tolerance providing a more consistent and cost effective sprinkler assembly for use in dry pipe applications. Accordingly, the present disclosure provides a sprinkler including a sprinkler body with a thermally responsive element mounted to the sprinkler body. A housing is provided including an inlet and an outlet end, with the outlet end being connected to the sprinkler body. A seal member is disposed at the inlet end of the housing, and a load mechanism extends between the thermally responsive element and the seal member. The sprinkler can be connected to a water or fire suppressant supply piping network in a heated area and penetrate the wall or ceiling enclosure allowing the sprinkler fusible trigger and distribution device to be located in a freezing area of a warehouse storage application. The system provides a sealed inlet connection located at the temperature controlled supply piping system and includes a dry barrel extension through the wall of the compartment to a freezing area and a discharge sprinkler device that includes a fusible trigger mechanism and distribution surface to accurately discharge fire suppressant over a protected fire area within the compartment. The present disclosure provides a dry sprinkler assembly for use with large K factor sprinklers in which an orifice outlet member can be selectively provided in order to vary the K factor for the sprinkler assembly without having to modify other components thereof.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
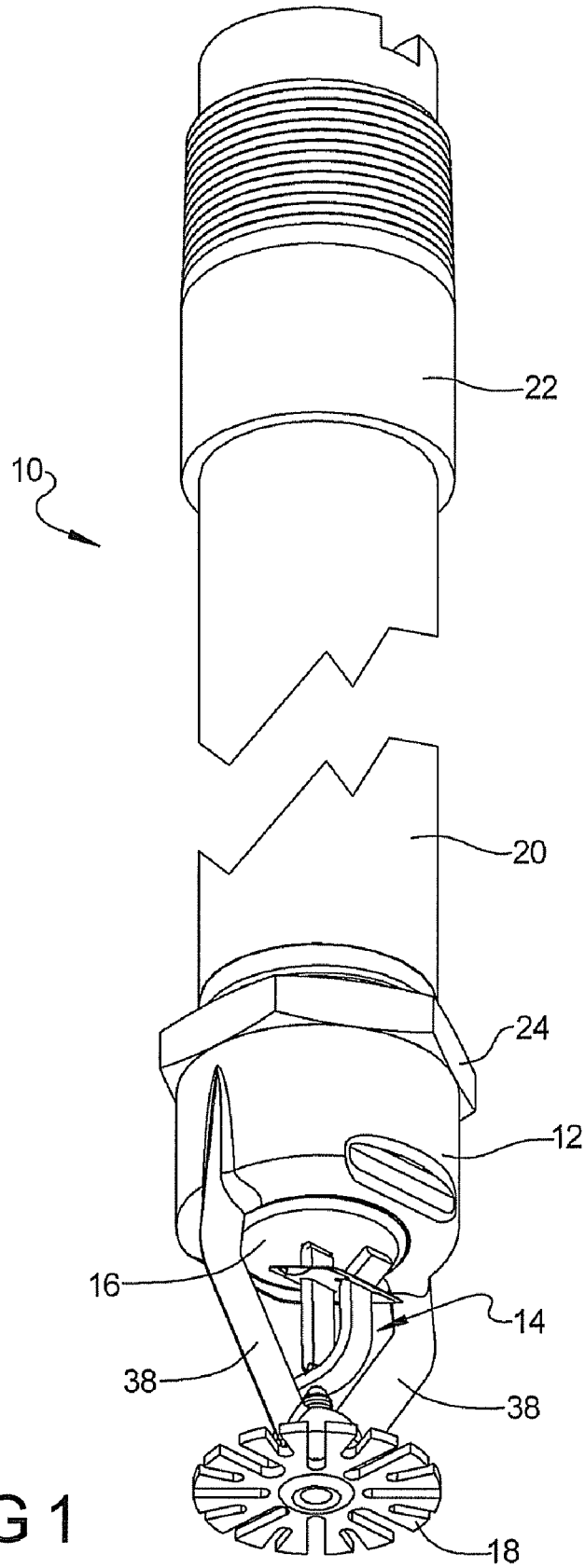
FIG. 1 is a perspective view of a dry sprinkler assembly according to the principles of the present disclosure.

The following description is merely exemplary in nature and is not intended to limit the present disclosure, application, or uses. It should be understood that throughout the drawings, corresponding reference numerals indicate like or corresponding parts and features.

With reference to FIG. 1, the dry pipe sprinkler assembly 10, according to the principles of the present disclosure, will now be described. The dry pipe sprinkler assembly 10 includes a sprinkler body 12 including a thermally responsive element 14 mounted thereto. The thermally responsive element 14 engages a support plug or pip cap 16. A deflector 18 is mounted to the sprinkler body 12. The sprinkler body 12 is mounted to an outer housing 20 which, in turn, is mounted to an inlet body 22. A lock nut 24 is threadedly engaged with the outer housing 20 and is disposed against the sprinkler body 12.

Figure 2:
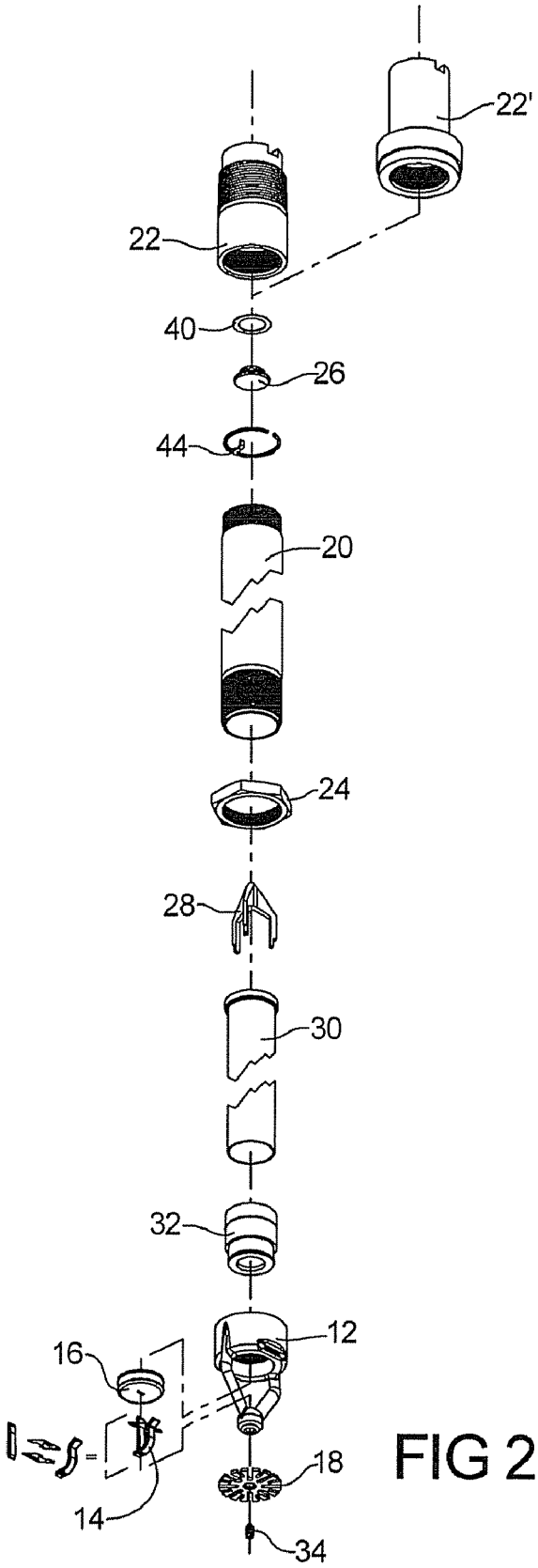
FIG. 2 is an exploded perspective view of the dry sprinkler assembly shown in FIG. 1.
Figure 3:
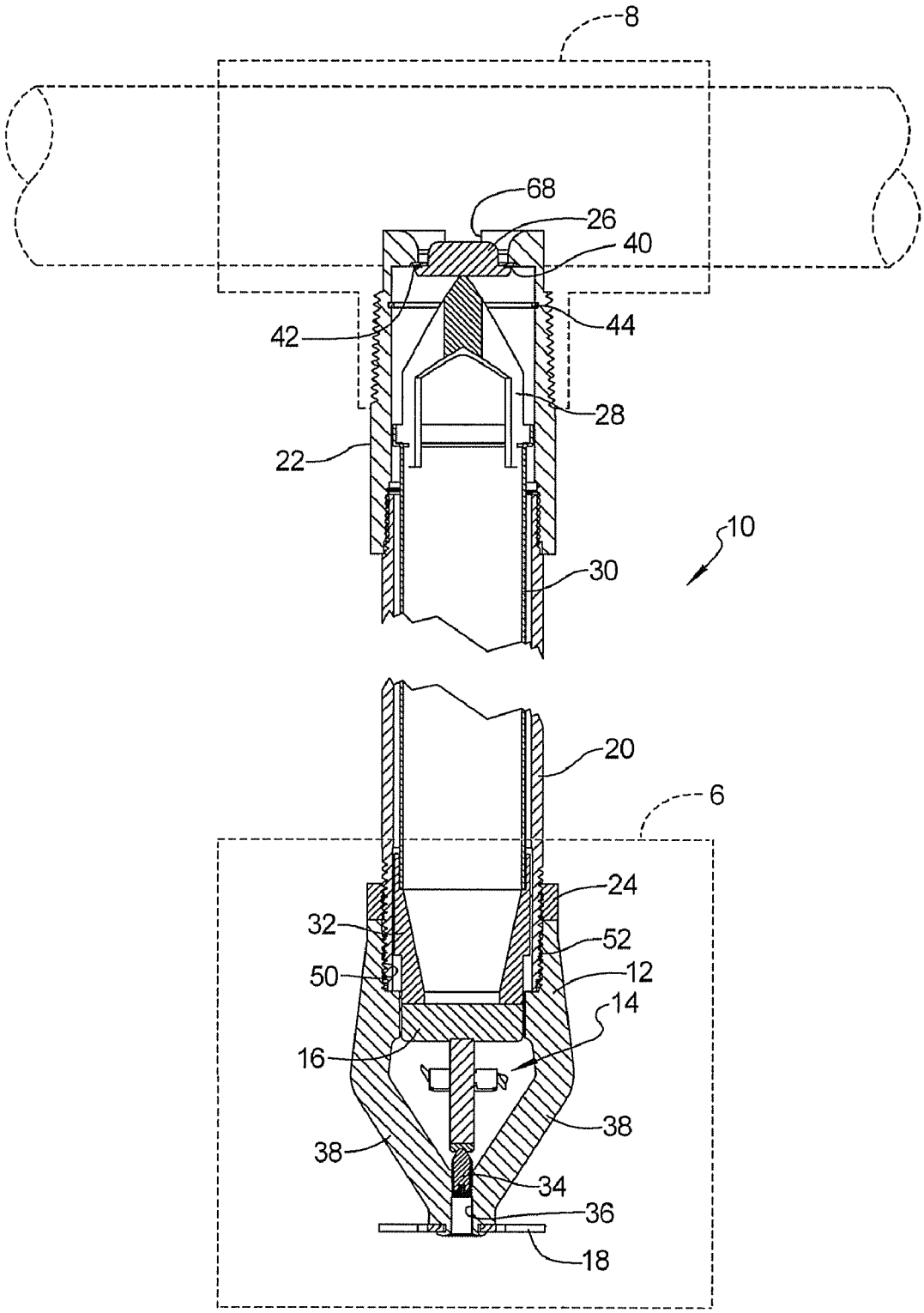
FIG. 3 is a cross-sectional view of the dry sprinkler assembly of FIG. 1.
Figure 4:
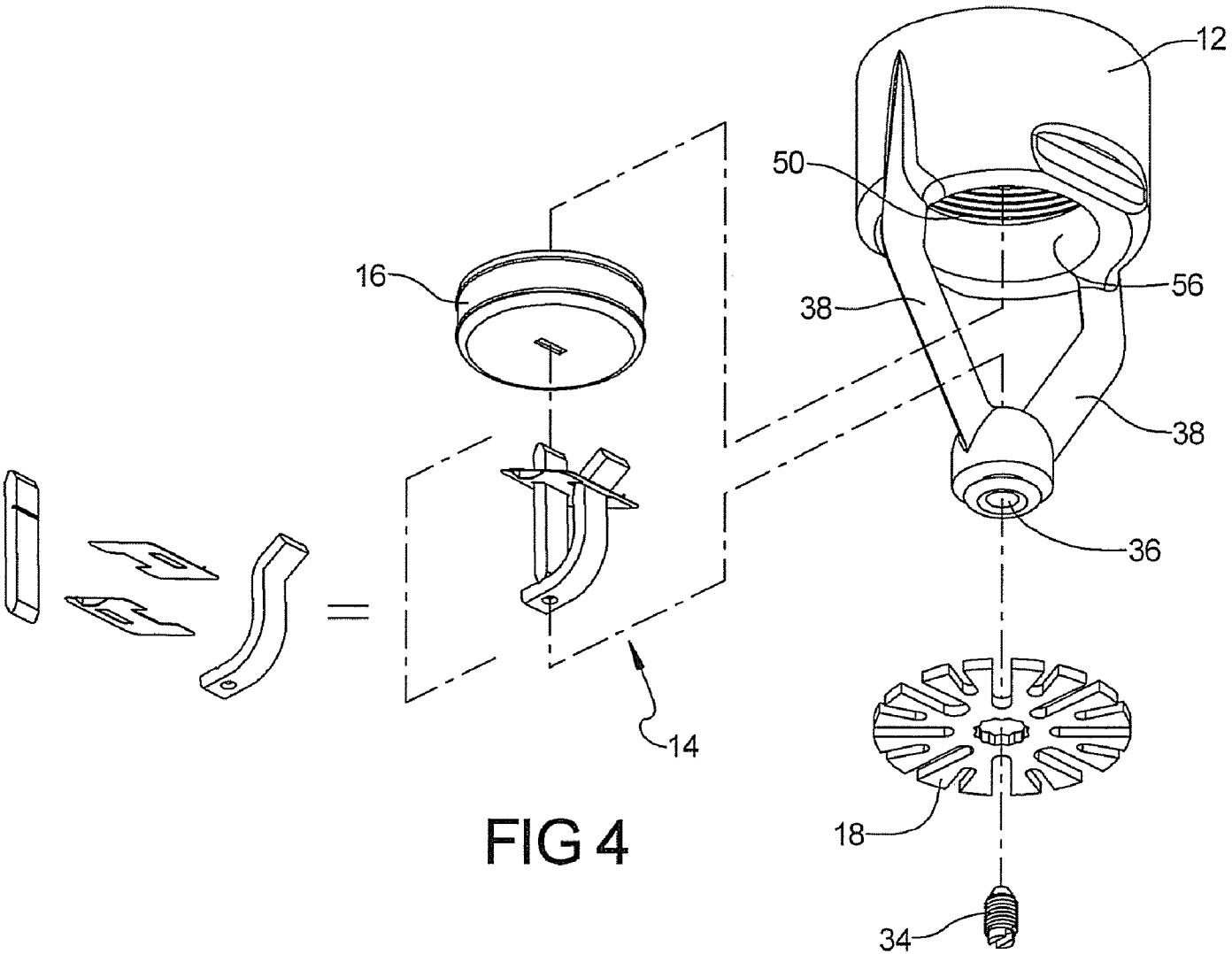
FIG. 4 is an exploded view of the outlet sprinkler and trigger assembly according to the principles of the present disclosure.

With reference to FIGS. 2 and 3, the dry pipe sprinkler assembly 10 includes a load mechanism extending between the thermally responsive element 14 and a base seal member 26. The load mechanism includes a seat support 28, an inner passage tube 30 and an outlet orifice 32. As shown in FIG. 3, the inner passage tube 30 and the outer housing 20 extend through a wall of a freezing compartment 6. The freezing compartment 6 is a box enclosure controlled at a cool or freezing temperature. Also shown in FIG. 3. the seat support 28 engages the base seal member 26 at a first end thereof, and engages the inner passage tube 30 at a second end thereof. The inner passage tube 30 engages the outlet orifice member 32 and the outlet orifice member 32 engages the support plug 16. The thermally responsive element 14 is disposed between the support plug 16 and a pintle screw 34 that is threadedly received in a threaded boss 36 provided at the end of the frame arms 38 of the sprinkler body 12. The seal base member 26 is disposed against a spring seat 40 in the form of a Belleville spring washer. The spring seat 40 is disposed against a seating surface 42 provided on the inlet end of the inlet body 22.

Figure 5:
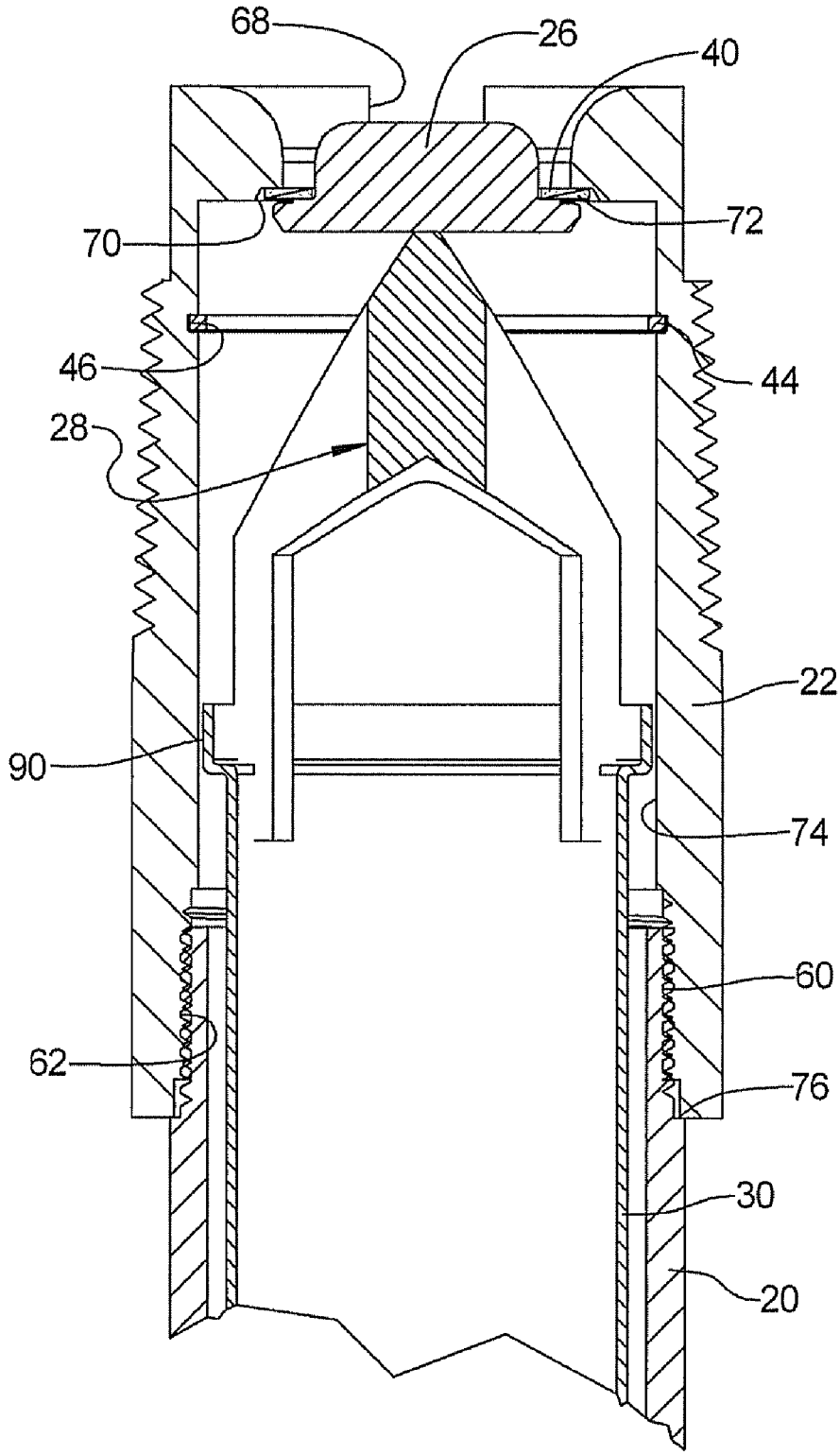
FIG. 5 is an enlarged cross-sectional view of the inlet end of the sprinkler assembly shown in FIG. 1.
Figure 18:
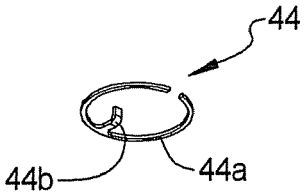
FIG. 18 is a perspective view of a displacement ring according to the principles of the present disclosure.
Figure 19:
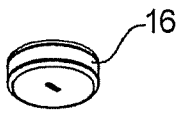
FIG. 19 is a perspective view of the pip cap according to the principles of the present disclosure.

A displacement ring 44 is received in a recessed groove 46 provided on the interior surface of the inlet body 22, as best shown in FIG. 5. As shown in FIG. 18, the displacement ring 44 includes an annular ring portion 44*a* and a radially inwardly extending finger portion 44*b* that causes the seal body 26 to be tilted when the thermally responsive element 14 of the sprinkler assembly 10 is activated so as to prevent the seal body 26 from becoming lodged within the inlet body and thereby preventing proper flow of fire suppressant therethrough.

Figure 6:
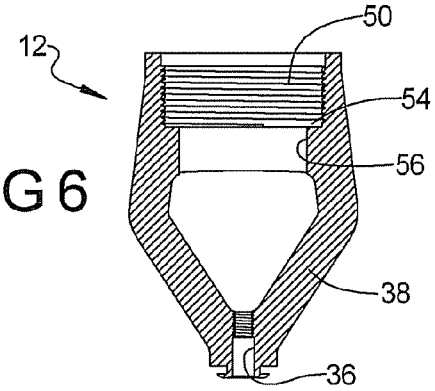
FIG. 6 is a cross-sectional view of the sprinkler body.
Figure 7:
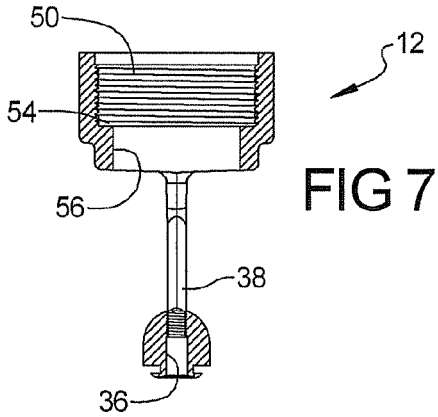
FIG. 7 is a cross-sectional view of the sprinkler body taken transverse to the cross-sectional view of FIG. 6.
Figure 8:
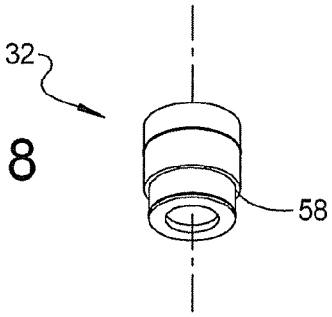
FIG. 8 is a perspective view of an orifice outlet member according to the principles of the present disclosure.
Figure 9:
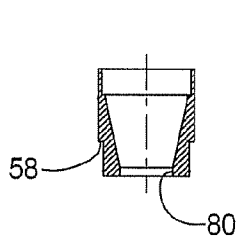
FIG. 9 is a cross-sectional view of the outlet orifice shown in FIG. 8.

With reference to FIGS. 6 and 7, the sprinkler body 12 includes an internally threaded portion 50 which engages externally threaded portion 52 of the outer housing 20. The internal threads 50 on the sprinkler body 12 allow the housing 20 to have a reduced size. The sprinkler body 12 further includes a stop portion 54 disposed adjacent to the threaded portion 50 and includes a bearing surface 56 that receives the support plug 16 thereagainst. As shown in FIG. 3, the stop surface 54 is spaced from a shoulder portion 58 provided on the outlet orifice member 32. The stop surface provides a limit on the axial travel of the outlet orifice member 32 when the thermally responsive trigger 14 is activated.

Figure 15:
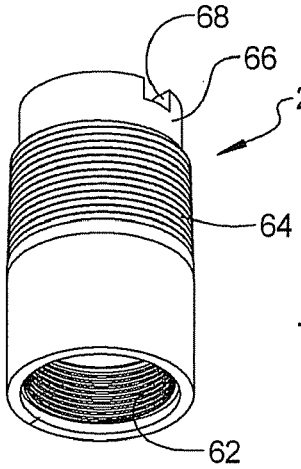
FIG. 15 is a perspective view of the inlet body according to the principles of the present disclosure.
Figure 16:
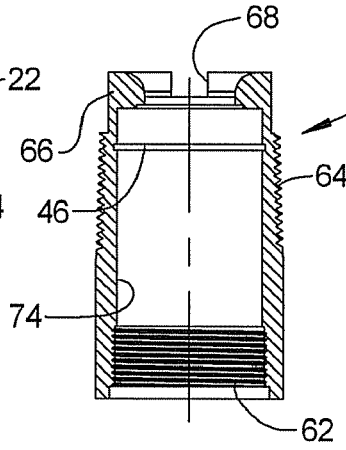
FIG. 16 is a cross-sectional view of the inlet body of FIG. 15.
Figure 17:
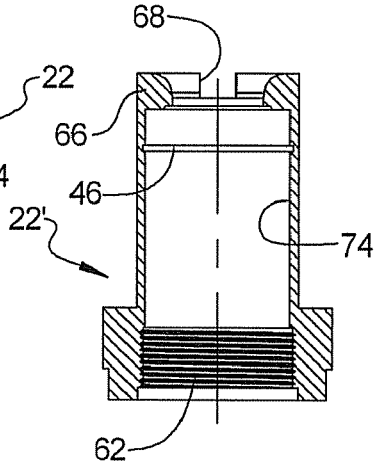
FIG. 17 is a cross-sectional view of an alternative inlet body with a grooved inlet connection for connection to a piping system according to the principles of the present disclosure.
Figure 20:
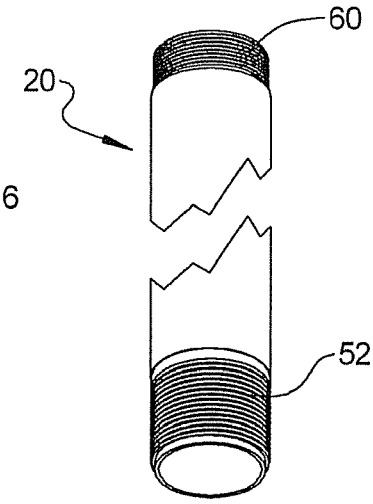
FIG. 20 is a perspective view of the outer housing according to the principles of the present disclosure.
Figure 21:
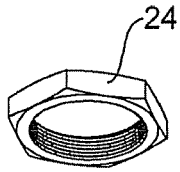
FIG. 21 is a perspective view of a lock nut according to the principles of the present disclosure.

With reference to FIGS. 5 and 20, the outer housing 20 includes external threads 60 at an inlet end thereof for engaging internal threads 62 provided on the outlet end of the inlet body 22. With reference to FIGS. 15 and 16, the inlet body 22 is adapted to be engaged with a T-joint or elbow of a sprinkler piping system 8, as best shown in FIG. 3. As shown in FIGS. 15 and 16, the inlet body 22 can be provided with external threads 64 for threadedly engaging the system piping. Alternatively, as shown in FIG. 17, the inlet body 22' can be configured to provide a grooved inlet connection with the sprinkler system piping 8 or, alternatively, can be provided with other coupling configurations, as known in the art. The connection of the inlet body 22 is made so that the liquid suppressant flows through the device from the piping system 8. Further, the inlet body includes a protruding portion 66 that protrudes into the piping system 8 so as to prevent a frost plug from forming on the inlet body 22 in the area of the seal 26. Slots 68 are machined into the protruding portion on the inlet body 22 to further prevent a frost plug. The slots 68 allow water or other liquids that are retained within the inlet end of the inlet body and additional debris to pass out of the inlet body when the piping system 8 is drained for maintenance, testing, or other purposes.

As mentioned previously, the inlet body 22 further includes the recessed groove 46 for receiving the displacement ring 44 therein. The displacement ring 44 is positioned in a precise location that prevents the seal base member 26 and spring seat 40 assembly from lodging upon activation of the thermal element 14. The position of the connection is designed to prevent the seal base 26 and spring seat 40 assembly from hanging up on the seat support 28 to allow the seal base 26 and spring seat 40 to move to a position that is non-obstructing to the fluid flow through the dry pipe sprinkler assembly 10.

As best shown in FIG. 5, the inlet body 22 includes an angled surface 70 disposed adjacent to a seal seat surface 72. The angled sides 70 adjacent to the seating surface 72 position the spring seat 40 in the center of the inlet body 22. The angled sides 70 further prevent the misalignment of the seal when a substantial load is applied that would cause the seal to move.

The inlet body 22 further defines an internal bearing surface 74 against which the inner passage tube 30 bears against, and translates through, upon activation of the sprinkler head. The bearing surface 74 is designed with such tolerance as to allow the inner passage tube 30 to freely translate as the dry sprinkler ages and/or corrodes.

With reference to FIG. 20, the outer housing 20 is provided with two connection ends 52, 60 that accurately position the sprinkler head 12 relative to the seal 26. The connection of the housing 20 to the inlet body 22 consists of a positive stop 76, adjacent to threaded end 60, as best shown in FIG. 5. A connection of the housing 20 to the sprinkler head 12, best shown in FIG. 3, includes external threads 52 on the housing 20 that allows the sprinkler head 12 to be positioned at a specified distance from the seal 26. These threads 52 are also used to lock the position of the sprinkler body 12 by means of the lock nut 24 that bears against the sprinkler body 12.

The pintle screw 34 is rotated in the threaded boss 36 of the sprinkler body 12 to create a precise and predetermined translation of the thermal element 14, support plug 16, outlet orifice 32, inner passage tube 30, seat support 28, and seal base member 26, which causes a deflection of the spring seat 40 and creates a seal. The spring seat 40 is preferably coated with TEFLON that inhibits sticking of spring seat to the seat surface. The loading on the Belleville spring seat 40 creates an expandable seal that prevents the liquid suppressant from flowing through the device when the dry sprinkler assembly elongates due to thermal expansion of the materials in the environment that the sprinkler is subjected to. The support plug 16 is designed such that it has two ribs that bear against the outlet orifice 32. The ribs create an alignment of the support plug 16 to the sprinkler body 12, which prevents a buckling effect on the internal component assembly. The ribs are further designed to allows for free translation as the sprinkler ages or corrodes. The ribs are further designed to offer any residual water downstream of the seal 26, 40 in a loaded dry sprinkler to be expelled from the dry sprinkler 10 so as to prevent a frost plug.

The outlet orifice member 32 includes an outlet orifice 80 that defines the flow passage restriction for suppressant fluid passing therethrough which determines the discharge coefficient or K factor of the sprinkler head assembly. The K factor of the sprinkler assembly equals the flow of fluid, such as water, in gallons per minute through the passageway divided by the square root of the pressure of the fluid fed into the body in pounds per square inch gauge. Heretofore, dry pipe sprinklers have not been provided with a K factor of 14 or larger. With the present disclosure, multiple different outlet orifice members 32 can be provided with generally the same external dimensions, each having different sized outlet orifices 80, that can be utilized with the dry pipe sprinkler assembly 10 to utilize all common components except for different outlet orifice members 32 in order to provide different K factors for different end uses including K factors of 14 and larger. The inlet end of the outlet orifice member 32 is designed such that it receives the inner passage tube 30 therein. The inlet end of the outlet orifice provides a ledge 82 against which the inner passage tube 30 is disposed. The inlet end of the outlet orifice member 32 is designed to prevent crushing of the end of the inner passage tube 30 by receiving the inner passage tube 30 in such a fashion.

Figure 10:
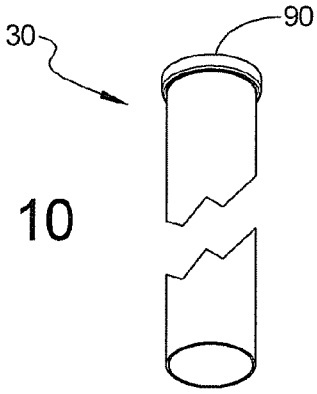
FIG. 10 is a perspective view of the inner passage tube according to the principles of the present disclosure.

The inner passage tube 30 includes a flanged end portion 90 as best illustrated in FIGS. 5 and 10, which is designed to receive the seat support 28 and provide a positive stop for the seat support 28. The outer surface of the flange portion 90 is designed to have a bearing surface that bears against and translates through the inlet body 22. The bearing surface on the external portion of the flange portion 90 is designed such that it allows for free translation as the sprinkler ages or corrodes. The inner passage 30 is designed to have a sufficient diameter so as to prevent the restriction of the liquid suppressant through it. Outer housings 20 of various lengths can be utilized that connect the sprinkler body 12 to the supply piping 8. Corresponding inner passage tubes 30 are also provided having various lengths associated with each outer housing length to provide the appropriate spacing for the load mechanism. A wide range of manufacturing tolerances can be accommodated by the threaded connection between the sprinkler body 12 and outer housing 20 with the lock nut 24 providing an adjustable positive stop.

Figure 11:
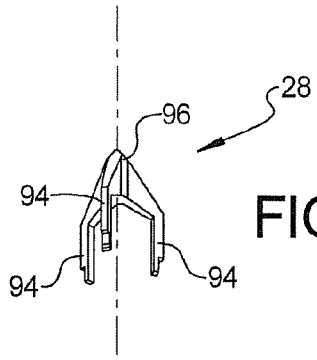
FIG. 11 is a perspective view of the seat support according to the principles of the present disclosure.
Figure 12:
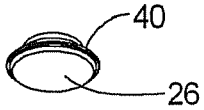
FIG. 12 is a perspective view of the spring base and spring seat assembly according to the principles of the present disclosure.
Figure 13:
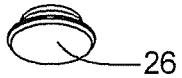
FIG. 13 is a perspective view of the spring base shown in FIG. 12.

The seat support 28 is comprised of three legs 94, as best illustrated in FIG. 11, that transfer the load from the inner passage tube 30 to the pointed tip 96 at the center of the support 28 and against the seal base 26. Each leg 94 of the seat support 28 is designed to be compressed into the inner passage tube 30 so as to provide an equal loading of each leg. The legs 94 are further designed to enter the inner passage tube 30 to a specified distance, which prevents buckling and creates an accurate position of the internal components.

Figure 14:
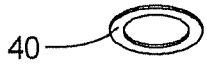
FIG. 14 is a perspective view of the spring seat shown in FIG. 12.

The seal base 26 is designed such that it is of sufficient thickness to translate the load to the spring seat 40. The seal base 26 is further designed with a certain outside dimension that will allow the seal base to enter the position between the legs of the support 28, thereby creating the maximum flow area through the inlet body 22. The seal base 26 is further designed to receive the spring seat 40 and firmly attach the spring seat so as to prevent the spring seat from becoming detached as the liquid suppressant flows through the dry pipe sprinkler assembly 10. The seal base 26 is further designed with a sealing surface that the spring seat 40 bears against to prevent the flow of the liquid suppressant. The seal seat 40, as best shown in FIG. 14, comprises a Belleville spring washer with a non-stick coating, such as TEFLON. The spring seat 40 is designed such that when compressed to a specific height, the spring seat 40 will prevent the flow of the liquid suppressant. The Belleville spring washer 40 will create a seal on both sides of itself. One seal will be made with the inlet body 22 and the other seal is made with the seal base 26.

In operation, the dry pipe sprinkler assembly 10 is designed such that when the thermally responsive element 14 is activated due to heat, the support plug 16 is ejected from the sprinkler body 12 from the translation of the outlet orifice member 32, inner passage tube 30, seat support 28 and seal base 26 that is forced by the spring seat 40 and the pressure of the liquid suppressant. The translation of the load mechanism defined by the outlet orifice 32, inner passage tube 30, and seat support 28, as well as the seal base is stopped as the outlet orifice reaches the positive stop 54 on the sprinkler body 12. The seal base 26 translates until it touches the radially extending finger 44*b* of the displacement ring 44 and then is rotated before being further translated downstream into the legs 94 of the seat support 28. The flow of the liquid suppressant is then at its maximum potential at the outlet orifice 32. The outlet orifice member 32 allows the liquid suppressant to flow through it at the desired K factor as selected by the installer.

For purposes of the present disclosure, an exemplary system has been disclosed. However, it should be understood that the exemplary system should not be limiting on the claims of the present application. In particular, it should be understood that the load mechanism which has been described herein, as including the support member 28, inner passage tube 30, and outlet orifice member 32 can be made of three independent members, as described, or can be made of more or fewer elements so as to be formed as a one-piece member or as to include two or more pieces. Furthermore, the housing can include a tubular housing 20 and inlet body 22 as described as separate elements, or can be formed as a single element, or can be formed as more than two elements. Furthermore, it should be understood that although a dry pipe sprinkler assembly 10 has been described and illustrated utilizing a linkage-type thermally responsive element 14, other known thermally responsive elements, such as bulb-type, can also be utilized in connection with the design of the present application. Further, the thermally responsive element 14 may have an RTI of 100 meter$^{1/2}$ sec$^{1/2}$ or less in order to be an ESFR sprinkler.

What is claimed is:

1. A sprinkler, comprising:

a sprinkler body;

a thermally responsive element mounted to said sprinkler body;

a housing including an inlet end and an outlet end, said outlet end being connected to said sprinkler body;

a seal member disposed at said inlet end of said housing; and a load mechanism extending between said thermally responsive element and said seal member, wherein said load mechanism includes a seat support engaging said seal member and a passage tube portion engaging said seat support, and wherein said seat support and said passage tube portion are slidable relative to said housing wherein said sprinkler body is threadably connected to said housing, further comprising a lock nut threadably engaged with said housing and disposed against said sprinkler body.

* * * * *